US006637296B1

(12) United States Patent
Dagenais et al.

(10) Patent No.: US 6,637,296 B1
(45) Date of Patent: Oct. 28, 2003

(54) JAW ASSEMBLY FOR GRIPPING PIPES

(76) Inventors: Dan Dagenais, 11025 - 82 Ave. N.W., Edmonton, Alberta (CA), T6G 0T1; Jonathan Brent Fraser, 21 Morgan Crescent, St. Alberta, Alberta (CA), T8N 2E1; Leslie L. Szalacsi, R R 3, Ononway, Alberta (CA), T0E 1V0; Hermann Basler, Box 2162, Stony Plain, Alberta (CA), T7Z 1X7

( * ) Notice: Subject to any disclaimer, the term of this patent is extended or adjusted under 35 U.S.C. 154(b) by 0 days.

(21) Appl. No.: 10/135,384

(22) Filed: May 1, 2002

(51) Int. Cl.[7] ..... B25B 13/50; B25B 13/58
(52) U.S. Cl. ..... 81/57.15; 81/185.1
(58) Field of Search ..... 81/57.15–57.21, 81/185.1, 186; D8/21, 24, 27

(56) References Cited

U.S. PATENT DOCUMENTS 2,962,919 A * 12/1960 Grundmann et al. ..... 81/186
4,576,067 A * 3/1986 Buck ..... 81/185.1
5,221,099 A * 6/1993 Jansch ..... 279/151
5,451,084 A * 9/1995 Jansch ..... 294/1.1
5,911,796 A * 6/1999 Buck ..... 81/57.33
6,253,643 B1 * 7/2001 Buck ..... 81/57.33
6,378,399 B1 * 4/2002 Bangert ..... 81/57.15

* cited by examiner

*Primary Examiner*—Lee D. Wilson
*Assistant Examiner*—David B. Thomas
(74) *Attorney, Agent, or Firm*—David J. French

(57) ABSTRACT

A jaw assembly for a power tong or back-up tong is provided with a jaw die plate and die seating surface that are shaped to permit radial insertion of the die plate onto its seating surface. Both vertical and horizontally aligned splines, or spline segments are present on the seating surface. Grooves between the protrusions on the mating surface of the die plate interfit between the splines and/or spline segments to stabilize the die plate and to absorb both rotational torque forces and vertical shearing forces without disengagement from its seating surface.

5 Claims, 4 Drawing Sheets

JAW ASSEMBLY FOR GRIPPING PIPES

FIELD OF THE INVENTION

This invention relates to an apparatus for gripping tubular members and, in particular, pipes in the oil well industry. More specifically, it relates to an interchangeable faceplate to be placed on a jaw carrier whereby the faceplate serves to engage reliably with pipe.

BACKGROUND TO THE INVENTION

In the oil and gas industry, in order to grip drill pipe it is necessary to apply high gripping forces while simultaneously rotating the pipe or restraining the pipe against rotation. Typically, such forces are now applied to pipe through the use of power tongs or a back-up tong. Within a power tong, a jaw assembly is rotatably mounted with provision for jaw surfaces within the assembly to receive and embrace the pipe once torque is to be applied. A back-up tong has similar jaw surfaces.

It is normal to use gripping plates which are inserted into the jaw assembly as the actual component that contacts with the pipe. These plates or die inserts are typically made of hardened metal and/or carry a gripping, eg. textured, surface which is suited for developing a high, frictional contact with the surface of pipe. They may also have smooth surfaces formed on softer metal. Such die inserts are installed within a jaw assembly at the focal point for the forces which are to be applied to pipe. Those forces include a rotational torque intended to turn the pipe in order to make or break pipe joints or carry-out rotation for drilling; a compressional force caused by the camming surface of the rotary gear forcing the jaw assembly to press up against the pipe, and vertical forces arising, as for example, when the weight of a power tong rests upon, or is dropped onto, the pipe.

As such jaw plates are subject to wear, they must be readily replaceable within the jaw assembly. Various systems for attaching jaw plates within a jaw assembly have been proposed. In particular, U.S. Pat. Nos. 4,576,067; 5,911,796 and 6,253,643 all to Buck describe a removable die plate which is provided with an external, convex surface having splines which run vertically. These splines mate with complementary grooves formed in the body of the jaw assembly. The splines serve to provide the necessary torque transfer between the jaw assembly and the jaw plates, serving to hold the die plate in place while rotating forces are applied to the pipe.

In U.S. Pat. No. 4,576,067 the die is held vertically in place by conventional means such as a screw that engages with a lip protruding from the convex surface of the die plate. While the splines of this prior invention provides a much greater and more robust surface area between the jaw assembly and the die plate to transfer rotational forces, the screw and lip arrangement makes little provision to absorb vertical forces that may arise when a section of pipe is lowered or raised vertically, carrying the power tong with it. The vertical forces arising under oil field conditions may be substantial. In the referenced U.S. patent above the only provision to accommodate such forces is the screw and lip feature as described. Depending on the dimensions of these components the lip and screw feature may be inadequate to support substantial vertical loads.

In U.S. Pat. 6,253,643 upper and lower lips or edges are provided to contain the jaw plate. These lips are emoveably attached to the jaw assembly by fasteners. To more securely absorb vertical loads arising between the jaw plate and jaw assembly, a curved insert is fitted into a keyway provided by opposed annular slots formed in the jaw plate and jaw assembly splined surfaces. Thus installation of this jaw plate also requires manipulation of an insert.

In the case of prior art designs the splines are cut with gear-like orientations. Consequently, the die plate must normally be slid into place. The die plate in these disclosures may not readily fit directly in place by a faceon-face insertion procedure due to the angles of the outer splines and grooves along the die plate edges.

It is an object of this invention to provide an improved form of die plate that is adapted to better transfer vertical forces between the die plate and the jaw assembly to which it is mounted and is more easily fitted into place. It is a further object of this invention to provide improved means for restraining a die plate against vertically-applied forces.

The invention in its general form will first be described, and then its implementation in terms of specific embodiments will be detailed with reference to the drawings following hereafter. These embodiments are intended to demonstrate the principle of the invention, and the manner of its implementation. The invention in its broadest and more specific forms will then be further described, and defined, in each of the individual claims, which conclude this Specification.

SUMMARY OF THE INVENTION

According to the invention in one aspect, a jaw assembly for gripping tubular members is provided which includes a concave seating surface within a jaw plate carrier portion of the jaw assembly, such concave seating surface having a plurality of parallel vertical grooves arcuately spaced on said concave surface, and a plurality of parallel, circular, horizontal grooves spanning said concave surface, preferably substantially from side to side. These grooves respectively define straight vertical and curved horizontal splines or spline segments. Spline segments arise from splines that are interrupted by gaps as further described below. Splines and spline segments qualify as spline means.

This concave seating surface mates with a jaw plate having a convex surface with a complementary array of vertically and horizontally aligned protrusions that are positioned and dimensioned to engage with portions of the vertical and horizontal grooves of the jaw plate carrier portion, there being slots between such protrusions to intimately receive the splines and/or spline segments on the jaw plate carrier portion of the jaw assembly to thereby ensure the effective transfer of forces there between.

The pattern of the vertical and horizontal grooves and corresponding protrusions, is flexible. The horizontal grooves maybe bounded by the vertical grooves, above and below the horizontal grooves. Or the vertical grooves may be bounded by the horizontal grooves above and below the vertical grooves. And these respective grooves may be interspersed in any manner that provides satisfactory coupling between the jaw plate and the jaw plate carrier portion of the jaw assembly.

According to another aspect of the invention, the fit between the jaw plate and jaw plate carrier portion allows the jaw plate to be radially pressed into position by radial advancement of the jaw plate into the concave seating surface.

By a further aspect of the invention the horizontal splines may be interrupted by gaps that are aligned with the vertical grooves so as to allow a vertical sliding insertion of a die plate having strictly vertical splines and grooves on its convex surface. Such gaps convert the horizontal splines into spline segments. In such case, a radiably-insertable jaw plate according to the invention may mate with the jaw carrier seating surface with portions of the protrusions of the jaw plate extending into the horizontal grooves of the seating surface, in vertical alignment with the spline segments present on such seating surface. An advantage of providing a seating surface of this design is that such a seating surface may receive jaw plates having strictly vertically aligned slots and protrusions as well as jaw plates with dual types of protrusions, according to the invention.

The objective of providing an engagement surface between the jaw plate and the jaw carrier assembly as described is to enhance the capacity of the interface between these components to transmit not only a rotary torque to a pipe, but also to absorb vertical loads as well.

As described, a jaw plate, may be installed on the jaw plate carrier portion of a jaw assembly by being pressed radially in place.

The foregoing summarizes the principal features of the invention and some of its optional aspects. The invention may be further understood by the description of the preferred embodiments, in conjunction with the drawings, which now follow.

DESCRIPTION OF THE PREFERRED EMBODIMENT

Figure 1:
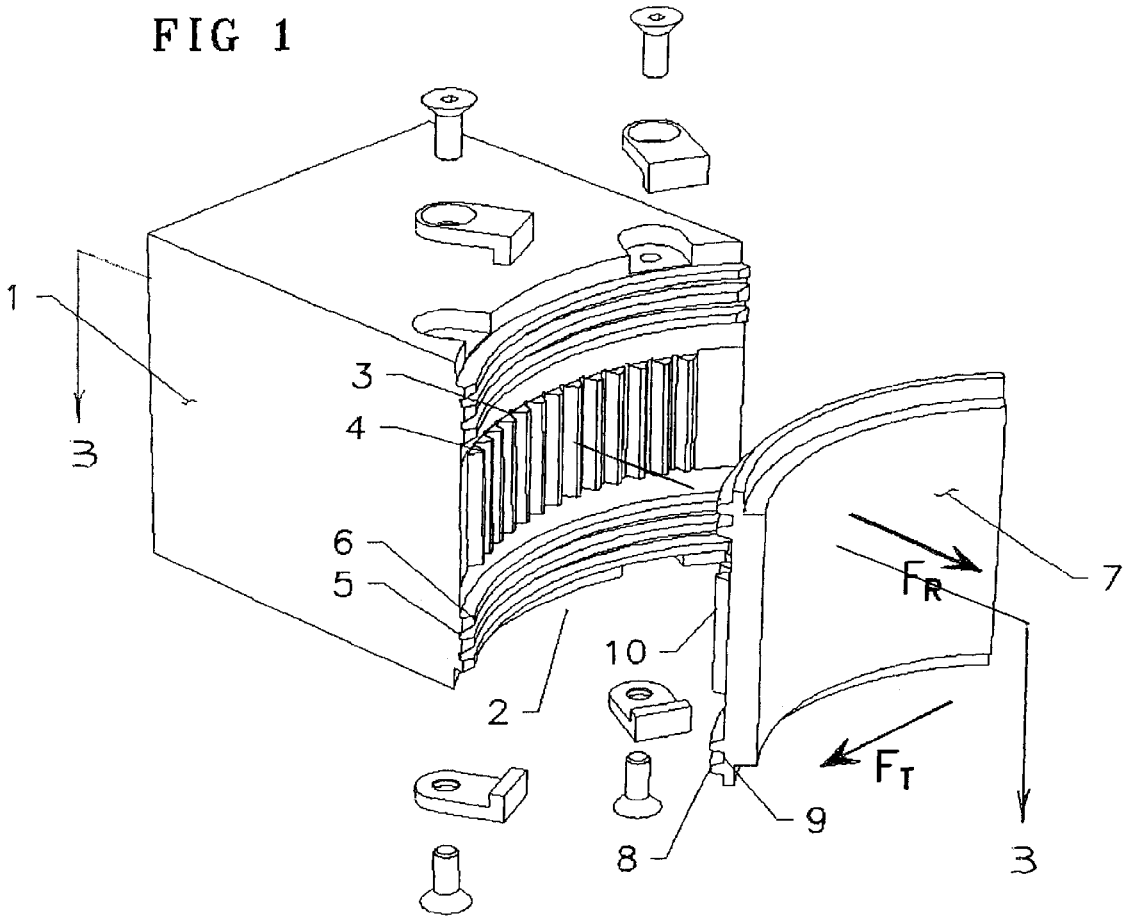
FIG. 1 is a perspective exploded view of a jaw plate carrier portion of a jaw assembly with a jaw plate according to the invention with both vertical and horizontal splines cut into the convex surface of the concave seating surface on the jaw plate carrier portion, aligned for engagement with a complementary pattern of grooves and protrusions formed on the convex surface of the jaw plate.
Figure 3:
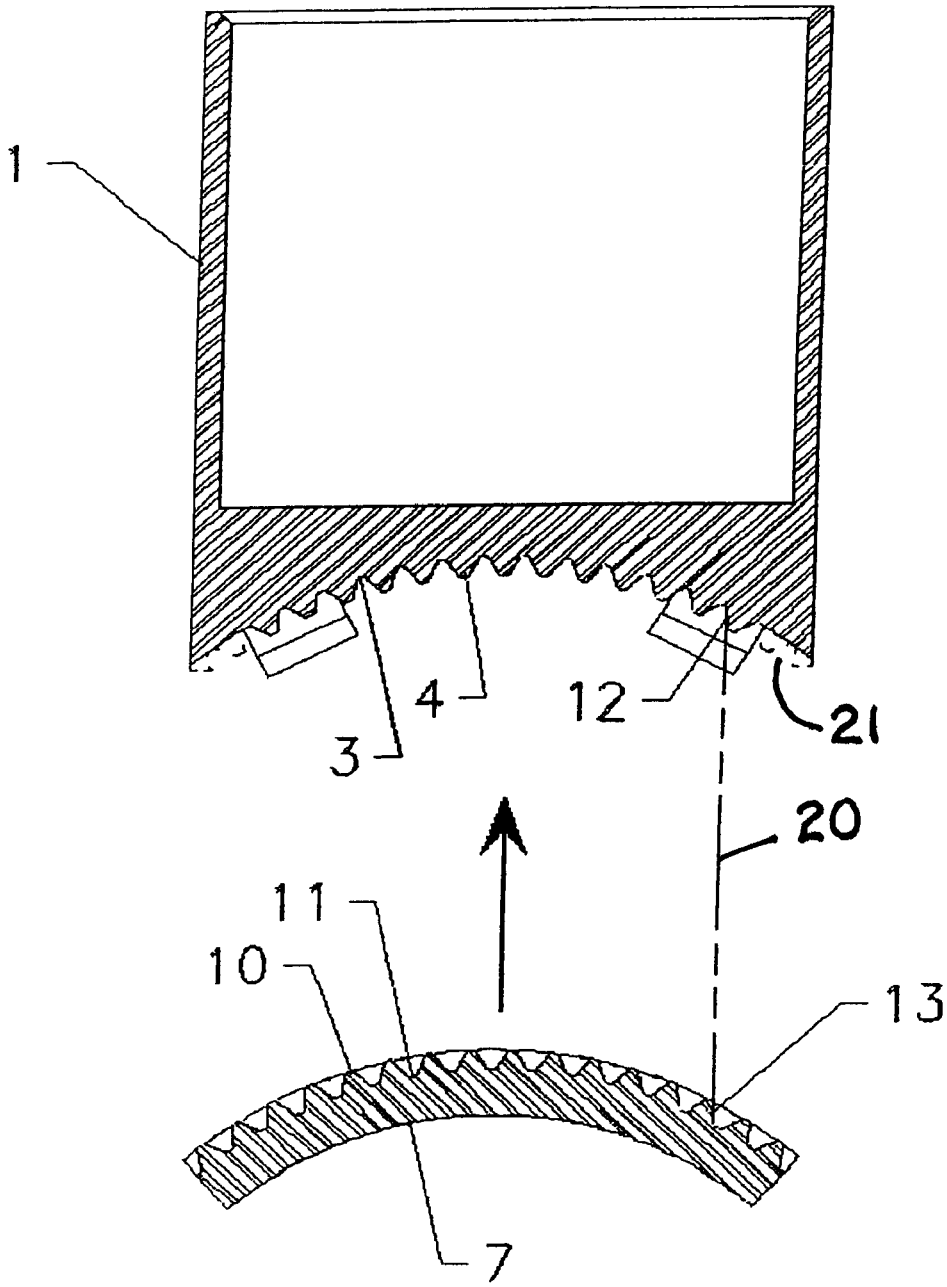
FIG. 3 is a top plan cross-sectional view taken through the central plane of the jaw carrier portion of FIG. 1, through the vertical splines and protrusion, aligned to receive a jaw plate of FIG. 2 onto the carrier convex jaw plate surface by radial advancement.

In FIGS. 1 and 3 a jaw plate carrier portion 1, or "carrier" 1 has a die plate engagement or seating surface 2 provided with vertical grooves 3 interspersed between vertical splines 4. The seating surface 2 also has horizontal grooves 5 interspersed between horizontal splines 6.

Figure 2:
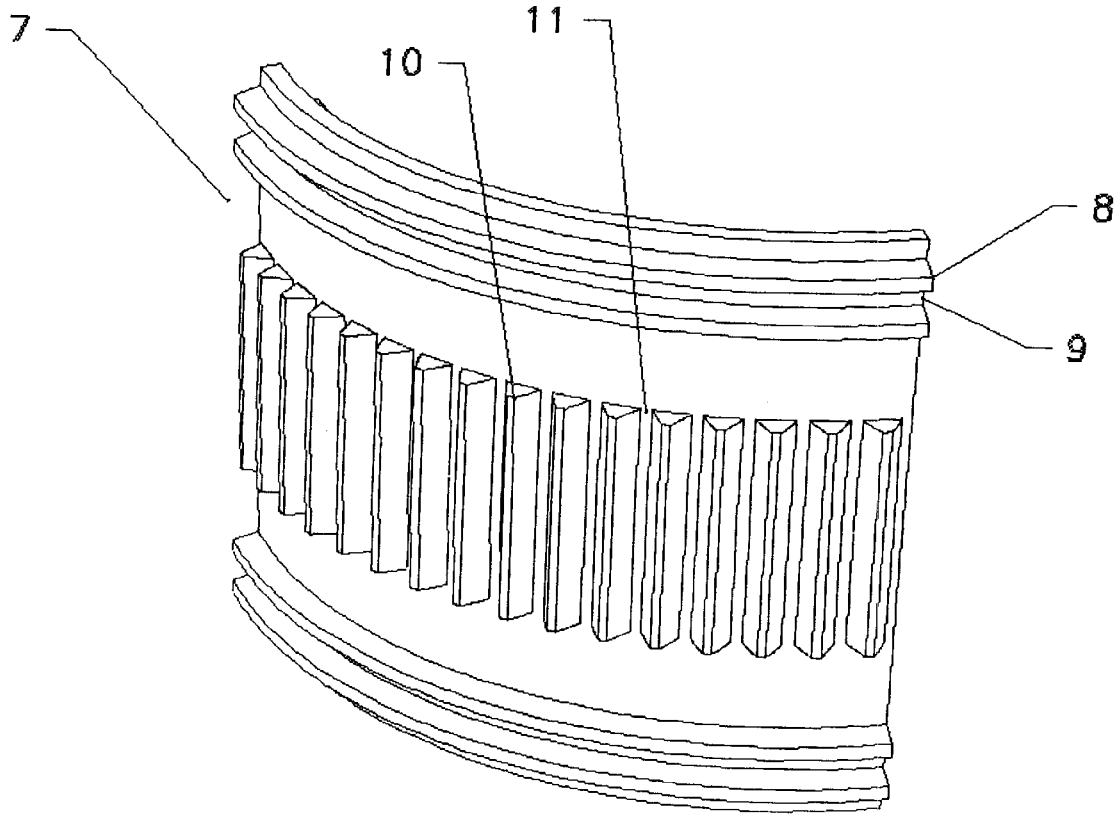
FIG. 2 is a perspective view of the jaw assembly engagement face surface of a jaw plate designed to engage the jaw plate carrier portion of FIG. 1.

In FIGS. 1, 2 and 3 a jaw plate 7 has horizontal protrusions 8 with intervening horizontal slots 9. These horizontal protrusions 8 and slots 9 interfit on assembly with the horizontal grooves 5 and splines 6.

The jaw plate 7 also has vertical protrusions 10 with intervening vertical slots 11. These vertical protrusions 10 and slots 11 interfit on assembly with the vertical grooves 3 and splines 4. Through contact between the vertical splines 4 and vertical protrusions 10, torquing forces FT may be transmitted to the die 7 while radial forcds FR are applied to a pipe.

It will be seen in FIG. 3 that the vertical splines 4 on the carrier 1 have sides 12 that are aligned to permit entry of the vertical protrusions 10 so that the side surface 13 of the vertical protrusions 10 may at least pass by spline side surface 12, and preferably mate with such side surface 12 when the jaw plate 7 is seated on the carrier 1.

The vertical line 20 shows these faces 12, 13 aligned at their limit to permit engagement when the protrusions are all similar in profile, as when made on a gear-cutting machine. Missing are protrusions at location 21 which would otherwise cause an interference.

Figure 4:
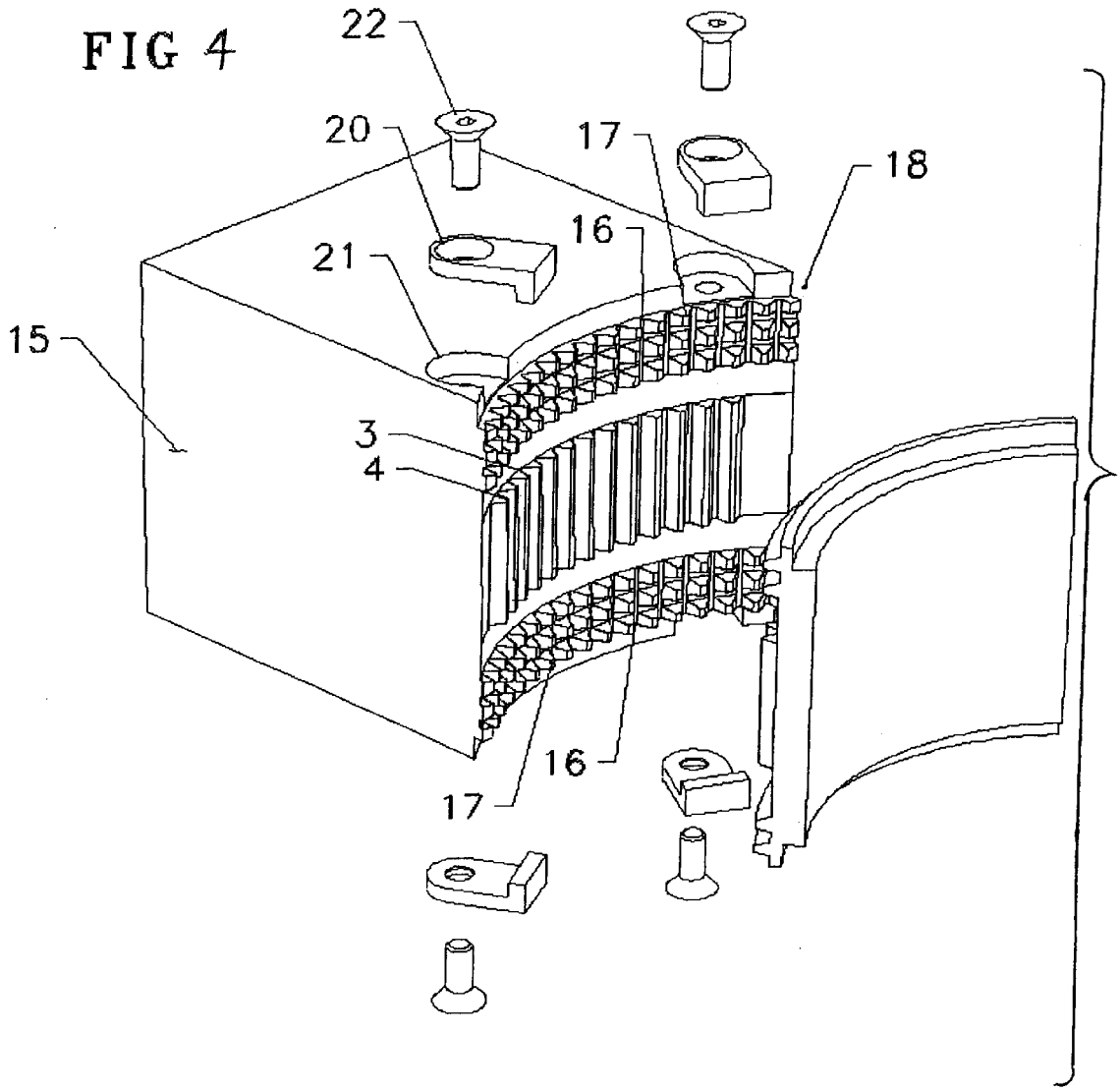
FIG. 4 is a perspective view of the concave seating surface on a jaw plate carrier portion similar to FIG. 1 wherein the horizontal splines are interrupted by gaps aligned vertically with the vertical grooves on the seating surface.

In FIG. 4 a modified carrier 15 has the same set of vertical splines 4. However, the horizontal splines 6 of FIG. 1 are interrupted by vertical gaps 16 to provide a series of vertical spline segments 17.

The jaw plate 7 is unchanged in FIG. 6 and will still mate with the modified seating surface 18 on the modified carrier 15. However the modified seating surface 18 will now receive a jaw plate (not shown) with strictly vertical protrusions and slots. As die plates of this type are already available on the market, this design allows users a choice as to the type of jaw plate they will employ.

In FIG. 4 coupling links 20 are fitted in seats 21, held by fasteners 22, to limit both vertical displacement of the jaw plate 7 and dislodgement of the jaw plate 7 from its seat 3, 18. As vertical forces are principally absorbed across the seating surface 3, 18, the links 20 may be of light weight and serve only for security during fitting of the jaw plate 7 to the carrier 15.

On the basis of the foregoing arrangement, a new and useful configuration for coupling replaceable jaw plates to jaw carrier assemblies has been described.

Conclusion

The foregoing has constituted a description of preferred embodiment of the invention and means by which the invention may be put into use. These embodiments are only exemplary. The invention in its broadest, and more specific aspects, is further described and defined in the claims which now follow. These claims, and the language used therein, are to be understood in terms of the variants of the invention which have been described. They are not to be restricted to such variants, but are to be read as covering the full scope of the invention as is implicit within the invention and the disclosure that has been provided herein.

What is claimed is:

1. A jaw assembly for gripping tubular members comprising a jaw plate carrier portion for receiving a jaw plate, said carrier portion having a concave jaw plate seating surface, such concave seating surface comprising a plurality of parallel vertical grooves arcuately spaced along said concave seating surface, with vertical spline means formed therebetween and further comprising a plurality of generally horizontal grooves extending arcuately along said seating surface and defining therebetween generally horizontal spline means.

2. A jaw carrier assembly as in claim 1 wherein the horizontal spline means comprises spline segments interspersed with gaps, said gaps being vertically aligned with the vertical grooves to permit the vertical sliding insertion of a die plate having vertically aligned slots and protrusion.

3. A jaw assembly as in claim 1 in combination with a jaw plate having a convex surface with a complementary array of vertical and horizontal protrusions interspersed by slots, said protrusions being positioned and dimensioned to matingly engage with the vertical and horizontal grooves of the jaw plate carrier portion, said slots being positioned and dimensioned to matingly receive said vertical and horizontal spline means to effect transfer of both vertical and rotational forces therebetween.

4. A jaw assembly as in claim 2 in combination with a jaw plate having a convex surface with a complementary array of vertical and horizontal protrusions interspersed by slots, said protrusions being positioned and dimensioned to matingly engage with the vertical and horizontal grooves of the jaw plate carrier portion, said slots being positioned and dimensioned to matingly receive said vertical and horizontal spline means to effect transfer of both vertical and rotational forces therebetween.

5. A jaw plate for engagement with a jaw plate seating surface on a jaw assembly of a power tong or backup tong, said jaw plate having a convex surface with an array of vertically and horizontally aligned protrusions interspersed by slots formed thereon for interengagement with spline means and grooves present on the jaw plate seating surface.

* * * * *